US010827816B2

(12) United States Patent
Takahashi

(10) Patent No.: US 10,827,816 B2
(45) Date of Patent: Nov. 10, 2020

(54) APPLICATOR

(71) Applicant: WINTRADING CO., LTD, Saitama (JP)

(72) Inventor: Hiroaki Takahashi, Saitama (JP)

(73) Assignee: WINTRADING CO., LTD, Saitama (JP)

( * ) Notice: Subject to any disclaimer, the term of this patent is extended or adjusted under 35 U.S.C. 154(b) by 435 days.

(21) Appl. No.: 15/742,225

(22) PCT Filed: May 10, 2017

(86) PCT No.: PCT/JP2017/017699
§ 371 (c)(1),
(2) Date: Jan. 5, 2018

(87) PCT Pub. No.: WO2017/195830
PCT Pub. Date: Nov. 16, 2017

(65) Prior Publication Data

US 2018/0199691 A1 Jul. 19, 2018

(30) Foreign Application Priority Data

May 11, 2016 (JP) ..... 2016-095306
Jan. 23, 2017 (JP) ..... 2017-009264
Feb. 7, 2017 (JP) ..... 2017-020247

(51) Int. Cl.
*A45D 34/04* (2006.01)
*A45D 40/24* (2006.01)
(Continued)

(52) U.S. Cl.
CPC ..... *A45D 34/042* (2013.01); *B43K 8/02* (2013.01); *A45D 34/04* (2013.01); *A45D 40/24* (2013.01);
(Continued)

(58) Field of Classification Search
CPC ..... A45D 34/042; A45D 34/04; A45D 2200/1009; A45D 40/262; A45D 40/26;
(Continued)

(56) References Cited

U.S. PATENT DOCUMENTS 5,967,687 A * 10/1999 Oike ..... B43K 8/04 401/198
6,695,517 B2 * 2/2004 Witz ..... B43K 8/04 401/198
(Continued)

FOREIGN PATENT DOCUMENTS

JP 47-47410 11/1972
JP 11-48678 2/1999
(Continued)

OTHER PUBLICATIONS

International Search Report dated Jun. 20, 2017 in International (PCT) Application No. PCT/JP2017/017699.

*Primary Examiner* — David J Walczak
(74) *Attorney, Agent, or Firm* — Wenderoth, Lind & Ponack, L.L.P.

(57) ABSTRACT

An applicator includes a body, an application member, a storage for a liquid applying material, a liquid applying material absorbing body configured to adjust an amount of impregnation, and a first plug configured to cause a rear end side of the application member to be inserted through an insertion hole to hold the application member. The first plug is configured to expose the rear end side of the application member to a side of the storage. A storage region is configured to be increased and decreased by changing a position of a second plug. The absorbing body is mounted to a distal end and is cuttable.

18 Claims, 14 Drawing Sheets

(51) Int. Cl.

| | |
|---|---|
| ***A45D 40/26*** | (2006.01) |
| ***B43K 8/02*** | (2006.01) |
| ***B43K 8/06*** | (2006.01) |
| ***B43K 1/00*** | (2006.01) |
| ***B43K 27/08*** | (2006.01) |
| ***B43K 5/18*** | (2006.01) |
| ***B43K 5/10*** | (2006.01) |

(52) U.S. Cl.
CPC ..... *A45D 40/26* (2013.01); *A45D 2200/1009* (2013.01); *B43K 1/003* (2013.01); *B43K 5/10* (2013.01); *B43K 5/18* (2013.01); *B43K 8/022* (2013.01); *B43K 8/026* (2013.01); *B43K 8/06* (2013.01); *B43K 27/08* (2013.01)

(58) Field of Classification Search
CPC ..... A45D 40/24; B43K 8/02; B43K 1/003; B43K 5/10; B43K 5/02; B43K 5/18; B43K 8/022; B43K 8/026; B43K 8/06; B43K 27/00; B43K 27/08
See application file for complete search history.

(56) References Cited

U.S. PATENT DOCUMENTS

| | | | | |
|---|---|---|---|---|
| 7,073,967 | B2 * | 7/2006 | Choi | B43K 8/04 401/199 |
| 7,374,356 | B2 * | 5/2008 | Oike | B43K 5/005 401/17 |
| 2003/0123922 | A1 | 7/2003 | Kabayashi | |
| 2005/0249542 | A1 | 11/2005 | Hori | |

FOREIGN PATENT DOCUMENTS

| | | |
|---|---|---|
| JP | 11-301168 | 11/1999 |
| JP | 2001-80269 | 3/2001 |
| JP | 2001-80277 | 3/2001 |
| JP | 2001-219693 | 8/2001 |
| JP | 2004-344858 | 12/2004 |
| JP | 2010-89383 | 4/2010 |
| JP | 2013-102910 | 5/2013 |
| JP | 2014-188969 | 10/2014 |
| KR | 20-2009-0005369 | 6/2009 |
| WO | 2004/000575 | 12/2003 |

* cited by examiner

Fig.3
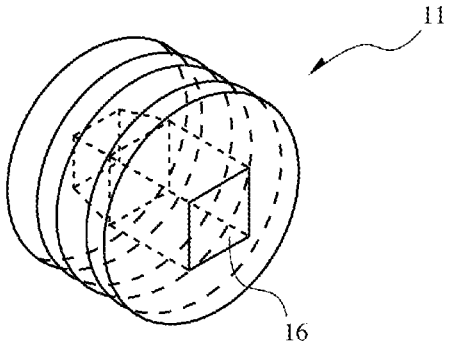
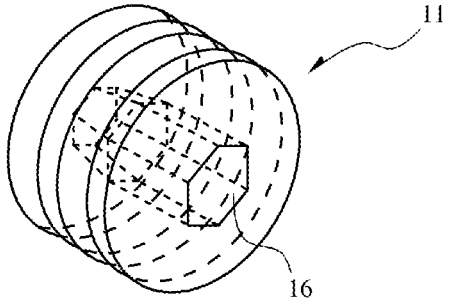

Fig.6

RESULT OF SWING INSPECTION AFTER LIQUID FILLING (a) BULK A (BLACK) VISCOSITY: 6.0 CP (CENTIPOISE)

NUMBER OF TIMES UP TO LIQUID LEAKAGE

| | NO COMPRESSION MEMBER | 4-mm COMPRESSION MEMBER | 5.5-mm COMPRESSION MEMBER |
|---|---|---|---|
| SAMPLE 1 | 6 | 8 | 12 |
| SAMPLE 2 | 6 | 7 | 11 |
| SAMPLE 3 | 5 | 9 | 13 |

(b) BULK B (BROWN) VISCOSITY: 5.0 CP (CENTIPOISE)

NUMBER OF TIMES UP TO LIQUID LEAKAGE

| | NO COMPRESSION MEMBER | 4-mm COMPRESSION MEMBER | 5.5-mm COMPRESSION MEMBER |
|---|---|---|---|
| SAMPLE 1 | 4 | 6 | 9 |
| SAMPLE 2 | 4 | 7 | 9 |
| SAMPLE 3 | 4 | 6 | 10 |

APPLICATOR

TECHNICAL FIELD

The present invention relates to an applicator that causes a liquid applying material accumulated inside, for example, a cosmetic tool, such as an eye liner and an eyebrow pencil, or a gray-hair partially dyeing tool for hair, an eyebrow, or a similar part, to be infiltrate into an application portion to use this liquid applying material for application or drawing from a distal end application portion.

BACKGROUND ART

Conventionally, there has been generally known an applicator such as an eye liner that internally accumulates a liquid applying material. The applicator includes an application member formed of a core material made of a fiber member or a similar member to absorb and infiltrate the liquid applying material. The applicator applies or draws the liquid applying material with a distal end application portion of this application member.

To adjust an amount of bulk output of the liquid applying material accumulated inside, these applicators usually include an absorbing body to cover the core material. This absorbing body has been made to adjust the amount of output of a liquid applying material delivered to the core material.

Conventionally, as illustrated in FIG. 5, this absorbing body 7 is typically manufactured with a resin molded product whose outer peripheral surface is formed into an uneven surface in an accordion shape. Designing the resin molded product has required many adjustments and has required a high cost for the mold.

A region of a storage 12 to internally accumulate the liquid applying material 6 is fixed; therefore, this region was not able to be changed.

The liquid applying materials 6 have a large number of different viscosities and materials depending on an aspect for use. An amount of accumulation of the liquid applying material 6 accumulated in the storage 12 also variously differs.

Accordingly, as described above, it has been regarded as difficult to use the applicator and the internal absorbing body 7 that handle the plurality of kinds of the liquid applying materials 6 and have a structure with identical shape and identical size including the cases of different amounts of accumulation.

That is, the following problems occur. Separately manufacturing the absorbing bodies 7 made of the resin molded products whose length or a similar dimension is changed requires the high cost for the mold. Changing the amount of accumulation requires a change in the size of the applicator itself.

Viscosity of the bulk differs depending on a kind of bulk liquid. Changing the shape of the applicator so as not to cause a liquid leakage according to the bulk liquid with different viscosities results in an extreme cost increase and is therefore utterly unacceptable.

Accordingly, applicators that can employ an applicator of identical standard even if the viscosity of the bulk differs and are each configured so as not to cause the liquid leakage have been requested.

Furthermore, when the bulk liquid accumulated in the applicator decreases, a general applicator is likely to fail holding the amount of output of the liquid applying material delivered to the core material. This is because that the applicator is often used in the parallel state or is often used by lowering the rear end side little and such use state fails to adjust impregnation of the bulk liquid from the storage to the core material well.

CITATION LIST

Patent Document

Patent Document 1: Japanese Unexamined Patent Application Publication No. 11-48678
Patent Document 2: Japanese Unexamined Patent Application Publication No. 2013-102910
Patent Document 3: Japanese Unexamined Patent Application Publication No. 2004-344858

DISCLOSURE OF THE INVENTION

Problems to be Solved by the Invention

Accordingly, an applicator of the present invention has been invented to solve the conventional problems. The object is to provide the applicator that ensures handling a plurality of kinds of bulk liquid even when a plurality of kinds of liquid applying material of different viscosities and materials accumulated to an inside, namely, bulk liquid are present and amounts of accumulation of the liquid applying material accumulated in a storage are variously different, ensures using an applicator of an identical standard such as a size and a shape even when viscosities of the bulk liquid are different, each of which being configured so as not to cause a liquid leakage. Additionally, the object is to provide the applicator that ensures adjusting impregnation of the bulk liquid from the storage to a core material even when a parallel use of the applicator or use by lowering the rear end side little continues long, and even when an amount of the bulk liquid decreases, the liquid does not run out to the end. Further, use of an applicator of a type ensuring double use as an applicator using the liquid applying materials on both sides, use of an applicator in which one side is an applicator and the other side is used as powder, and use of an applicator as gray-hair dyeing on the other side, a body of the identical standard can be used and manufactured. Thus, the object is to provide the applicator that ensures a reduced labor of manufacture and an inexpensive cost.

Solutions to the Problems

An applicator of the present invention includes an approximately cylindrical-shaped body, a core-like application member, a storage, a liquid applying material absorbing body, and a plug. The core-like application member is housed inside the body. The storage accumulates a liquid applying material to be impregnated into the application member. The liquid applying material absorbing body adjusts an amount of the impregnation of the liquid applying material to the application member. The plug causes a rear end side of the application member to be inserted through a bored insertion hole in the body to hold the application member. The plug exposes the rear end side to a side of the storage. The insertion hole has a shape in which a width of a clearance between the insertion hole and the inserted application member is adjustable according to viscosity and a material of the liquid applying material to make an amount of the liquid applying material infiltrated to a side of the liquid applying material absorbing body adjustable. The storage has a storage region for the liquid applying material configured to be increased and decreased by changing a mounting position of a stop plug. The liquid applying material absorbing body is mounted to the application member on a distal end side with respect to a mounting position of the plug. The liquid applying material absorbing body has changeable length and size configured to increase and decrease the amount of impregnation of the liquid applying material through cutting.

Alternatively, an applicator includes an approximately tube-shaped body, an application member, a storage, a liquid applying material absorbing body, and a compression member. The application member is housed inside the body. The storage accumulates a liquid applying material to be impregnated into the application member. The liquid applying material absorbing body adjusts an amount of the impregnation of the liquid applying material to the application member. The compression member compresses the liquid applying material absorbing body disposed inside the body in the body. The compression member has a structure by which a degree of the compression of the liquid applying material absorbing body inside the body is changeable and the amount of impregnation of the liquid applying material impregnated into the application member is adjustable.

Alternatively, the liquid applying material absorbing body is constituted of a foam material internally having an open cell structure.

Alternatively, the storage internally includes a ball for stirring.

Alternatively, an applicator includes an approximately cylindrical-shaped body, a core-like application member, and a storage. The core-like application member is housed inside the body. The application member has a tip end configured to perform drawing from one end in a longitudinal direction of the body. The storage is disposed in the body to accumulate a liquid applying material to be impregnated into the application member. The application member housed in the body has a rear end side exposed to a side of the storage to make the liquid applying material impregnatable into the application member and a rear end portion of the application member is held. The application member is in contact with an absorbing body mounted to an inside of the storage such that the absorbing body is configured to impregnate the liquid applying material. The absorbing body has changeable length and size configured to adjust an amount of the impregnation according to viscosity and a material of the liquid applying material.

Alternatively, the core-like application member is made of a fiber member such that the liquid applying material is impregnatable by capillarity.

Alternatively, the application member includes a long intermediate core and an application brush coupled to a distal end of the intermediate core.

Alternatively, an applicator for double use includes an approximately cylindrical-shaped body, a core-like application member, a storage, a liquid applying material absorbing body, and a rear end side partition wall. The core-like application member is housed inside the body. The application member is configured to perform drawing from one end side in a longitudinal direction of the body. The storage is disposed at a rear end side of the application member to accumulate a liquid applying material to be impregnated into the application member. The liquid applying material absorbing body adjusts an amount of the impregnation of the liquid applying material to the application member. The rear end side partition wall forms the storage. An application member is mountable in a space disposed from the partition wall toward another end side in the longitudinal direction of the body. The application member meets a standard identical to the core-like application member mounted to the one end side in the longitudinal direction of the body. When the application members are mounted on both sides of the body, the partition wall forming the storage is taken away such that the liquid applying material in the storage is usable for both the application members at both the sides of the body.

Alternatively, to the space on the other end side in the longitudinal direction of the body, a cosmetic member other than the application member is mountable instead of the application member. The partition wall is not taken away but left in the configuration.

Effects of the Invention

The applicator of the present invention can provide the applicator that ensures handling a plurality of kinds of liquid applying material even when a plurality of kinds of liquid applying material of different viscosities and materials accumulated to an inside are present and amounts of accumulation of the liquid applying material accumulated in a storage are variously different, ensures using an applicator of an identical standard such as a size and a shape even when viscosities of the bulk liquid are different, each of which being able to be configured so as not to cause a liquid leakage. Additionally, the applicator that ensures adjusting impregnation of bulk liquid from the storage to a core material even when a parallel use of the applicator or use by lowering the rear end side little continues long, and even when an amount of the bulk liquid decreases, the applicator in which the liquid does not run out to the end can be provided. Further, use of an applicator of a double use type as an applicator using the liquid applying materials on both sides, use of an applicator in which one side is an applicator and the other side is used as powder, and use of an applicator as gray-hair dyeing on the other side, a body of the identical standard can be used and manufactured. Thus, the applicator provides the excellent effects that ensure a reduced labor of manufacture and an inexpensive cost of the applicator handling double use.

BRIEF DESCRIPTION OF THE DRAWINGS

FIG. 3 is an explanatory view describing a configuration of a plug.

FIG. 6 is a description table describing results of a swing inspection after liquid filling.

DESCRIPTION OF PREFERRED EMBODIMENTS

Figure 1:
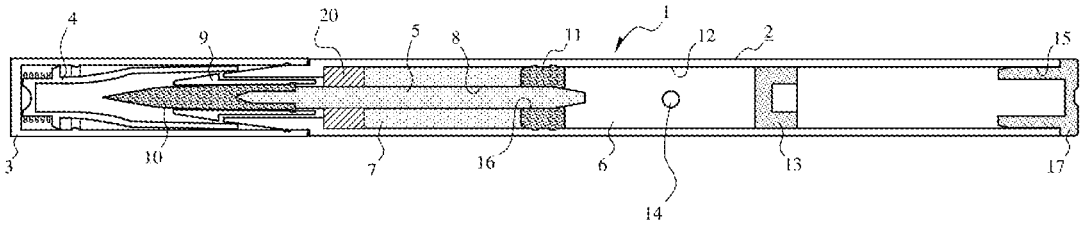
FIG. 1 is an explanatory view (1) describing a configuration of an applicator according to the present invention.
Figure 2:
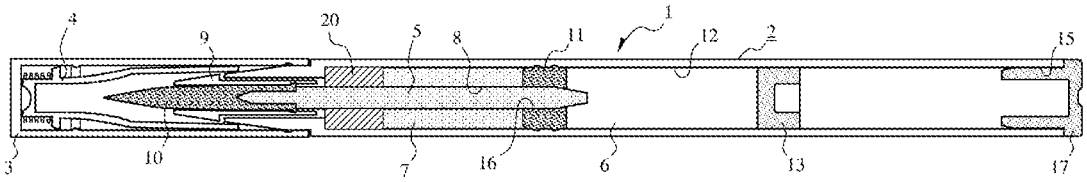
FIG. 2 is an explanatory view (2) describing the configuration of the applicator according to the present invention.

The following describes the present invention based on embodiments illustrated in the drawings.

Figure 14:
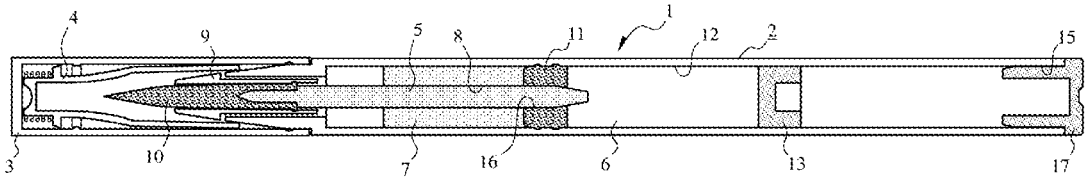
FIG. 14 is an explanatory view (6) describing a configuration of an applicator according to the present invention.

FIG. 1 and FIG. 14 are configuration explanatory views illustrating a configuration of an applicator 1 according to the present invention.

The applicator 1 according to the present invention includes an approximately cylindrical-shaped body 2. The applicator 1 also includes a cap 3 and an inner cap 4.

The body 2 internally holds a core-like application member 5. This application member 5 is usually made of a fiber member such that a liquid applying material 6, which will be described later, can be gradually impregnated by, for example, capillarity.

Reference numeral 7 denotes an absorbing body. As understandable from FIG. 1 and FIG. 14, this absorbing body 7 is formed into a columnar shape whose outer peripheral surface has no concavo-convex shape. The absorbing body 7 includes a through-hole 8, which axially passes through, at the center in the axial direction.

Figure 4:
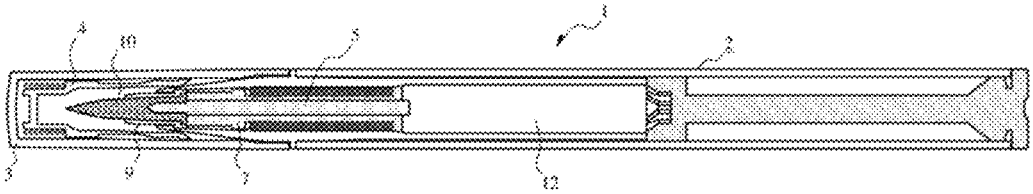
Fig.4 PRIOR ART
FIG. 4 is an explanatory view describing a configuration of a conventional applicator.
Figure 5:
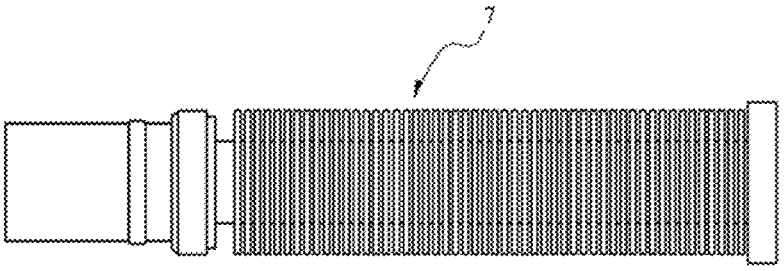
Fig.5 PRIOR ART
FIG. 5 is an explanatory view describing a configuration of a conventional absorbing body.

The application member 5 is inserted through and mounted to this through-hole 8. Conventionally, as illustrated in FIG. 4 and FIG. 5, this absorbing body 7 has been manufactured with a resin molded product whose outer periphery has been configured as an uneven surface in an accordion shape. However, as described above, the cost taken for the mold of the resin molded product is comparatively high. Therefore, manufacturing the absorbing bodies 7 with a plurality of different kinds of forms resulted in the expensive cost of the applicators themselves.

Accordingly, the absorbing body 7 of the present invention is formed of a flexible member with impregnation force such as a foam material internally having open cells. Easily cutting a size and a length of the absorbing body 7 can change the shape of the absorbing body 7. Additionally, the absorbing body 7 is configured such that compression in the longitudinal direction and the diameter direction can easily change the shape.

Reference numeral 9 denotes a nose piece. The nose piece 9 holds a distal end side of the core-like application member 5 and is fixedly secured to a tip end of the body 2. A drawing member 10 is fitted onto and mounted to the distal end side of the application member 5. This drawing member 10 performs drawing or an application with the impregnated liquid applying material 6.

Next, reference numeral 11 denotes a plug. The plug 11 causes a rear end side of the application member 5 to be inserted through the inside of the body 2 and holds the application member 5. The plug 11 causes the rear end portion to be exposed to the storage 12, which is formed adjacent to the plug 11. As understood from FIG. 3, as described above, the plug 11 causes the rear end side of the application member 5 to be inserted through the inside of an insertion hole 16 to hold the application member 5. A shape of this insertion hole 16 is formed into a different shape such as a square or a hexagonal shape. This configuration is made aiming to adjust a width of a clearance between the insertion hole 16 and the application member 5, which is inserted through the insertion hole 16, according to the viscosity and the material of the liquid applying material 6 and to adjust an amount of the liquid applying material 6 infiltrated to the absorbing body 7. Here, the storage 12 accumulates the liquid applying material 6.

Reference numeral 13 denotes a stop plug to form the storage 12. Thus, this stop plug 13 is mountable to any position of the body 2 in a longitudinal direction; therefore, a region for the storage 12 can be easily changed.

Reference numeral 14 denotes a ball. After the storage 12 accumulates the liquid applying material 6, putting this ball 14 into this storage 12 allows accelerating the impregnation of the liquid applying material 6 into the application member 5, thereby ensuring fully use of the liquid applying material 6 to the end. The applicator 1 without the ball 14 exists.

The following describes an assembly of the applicator 1. First, the drawing member 10 is mounted to the distal end side of the inside of the body 2 via the nose piece 9. The core-like application member 5 to which the absorbing body 7, which is cut to a desired length, and the plug 11 are mounted is mounted to the rear end side. Afterwards, the liquid applying material 6 is filled in the storage 12, which is configured to be the desired region space, from a rear end opening 15 of the body 2. The storage 12 is lidded with the stop plug 13 to accumulate the liquid applying material 6 in the storage 12. Afterwards, the rear end of the body 2 is lidded with a tail plug 17 to terminate the assembly.

The viscosity of the liquid applying material 6 depends on the kind of the liquid applying material 6; therefore, with the liquid applying material 6 with small viscosity, a liquid leakage has possibly occurred from the drawing member 10 mounted to the distal end of the application member 5.

However, to prevent this liquid leakage, although the conventional applicators have been configured by differentiating the length of the absorbing bodies 7 and differentiating the size of the storages 12, only this configuration failed to finally solve the liquid leakage.

Therefore, the invention illustrated in FIG. 1 has invented the following applicator 1 of the present invention. The applicator 1 can be constituted of the one kind of the applicator 1 that does not cause the liquid leakage according to the bulk viscosities of respective kinds even if the applicator where the absorbing body 7 designed to be the identical size (length) and the storage 12 designed to be the identical size are incorporated. That is, the body 2 internally includes a compression member 20. The compression member 20 compresses the absorbing body 7, which is housed in the body 2 of the applicator 1, to change the size (length) of the absorbing body 7.

The absorbing body 7 is, as described above, formed of the foam material that internally has the open cells. As understood from the drawing, this absorbing body 7 has the through-hole 8 through which the application member 5 axially passes.

As illustrated in FIG. 1, mediating the compression member 20 on one side of the absorbing body 7 compresses the absorbing body 7 in the longitudinal direction by the length of the mediated compression member 20. That is, with the absorbing body 7 with a length of 20 mm, mediating the compression member 20 with a length of 4 mm compresses the absorbing body 7 to the length of 16 mm, thus shortening the absorbing body 7.

Compressing the absorbing body 7, which is formed of the foam material internally having the open cells, increases adhesiveness of the absorbing body 7 with the application member 5 inserted through the through-hole 8. This suctions up the liquid applying material 6 penetrated to the application member 5 by capillarity. Accordingly, the extra liquid applying material 6 is not impregnated into the application member 5 and the drawing member 10, thereby ensuring preventing the liquid leakage of the liquid applying material 6.

FIG. 6 illustrates the experimental results. In FIG. 6, the three applicators 1 with similar configuration were created as a sample 1, a sample 2, and a sample 3. A swing inspection test was conducted on the respective samples with no compression member 20, with the compression member 20 with a length of 4 mm, and with the compression member 20 with the length of 5.5 mm after the liquid applying material 6 was filled. The swing inspection is an inspection that holds the applicator 1 and vertically swings the held applicator 1 several times. This inspection inspected the number of swings at which the liquid leakage occurred.

The viscosity of the liquid applying material 6 was designed to be 6.0 CP (centipoise).

Then, as shown in FIG. 6, among the samples with no compression member 20, swinging the sample 1 and the sample 2 six times caused the liquid leakage, and swinging the sample 3 five times caused the liquid leakage. In the case where the samples included the 4-mm compression member 20 inside the body 2 and the absorbing body 7 was compressed, swinging the sample 1 eight times caused the liquid leakage, swinging the sample 2 seven times caused the liquid leakage, and swinging the sample 3 nine times caused the liquid leakage.

Furthermore, in the case where the samples included the compression member 20 with the length of 5.5 mm and the absorbing body 7 was compressed, swinging the sample 1 twelve times caused the liquid leakage, swinging the sample 2 eleven times caused the liquid leakage, and swinging the sample 3 thirteen times caused the liquid leakage.

Next, the viscosity of the liquid applying material 6 was changed to 5.0 CP (centipoise) and the test was conducted again.

In the samples with no compression member 20, swinging the sample 1, the sample 2, and the sample 3 four times caused the liquid leakage. In the case where the samples included the compression member 20 with the length of 4 mm and the absorbing body 7 was compressed, swinging the sample 1 six times caused the liquid leakage, swinging the sample 2 seven times caused the liquid leakage, and swinging the sample 3 six times caused the liquid leakage.

Furthermore, in the case where the samples included the compression member 20 with the length of 5.5 mm and the absorbing body 7 was compressed, swinging the sample 1 and the sample 2 nine times caused the liquid leakage, and swinging the sample 3 ten times caused the liquid leakage.

Thus, compressing the absorbing body 7 in the longitudinal direction with the compression member 20 to increase the adhesiveness with the application member 5 does not penetrate the extra liquid applying material 6 to the application member 5 and the absorbing body 7 absorbs the extra liquid applying material 6.

Consequently, it has proved that the applicator 1 of the present invention does not cause the liquid leakage.

The following describes other embodiments of the present invention.

Figure 7:
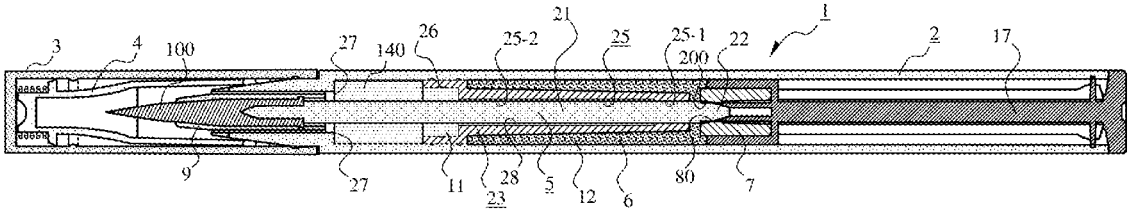
FIG. 7 is an explanatory view (3) describing a configuration of an applicator according to the present invention.

FIG. 7 is a configuration explanatory view illustrating the configuration of the applicator 1 according to another embodiment of the present invention. The applicator 1 according to the present invention includes the approximately cylindrical-shaped body 2. The length of this body 2 is at least specified by standard. Even if the viscosity and the material of the internally accumulated liquid applying material 6 are different, various kinds of the applicators 1 can be configured with the body 2 at the identical length. Therefore, even when the plurality of kinds of applicators 1 are formed, the identical body 2 is applicable, finally ensuring an inexpensive production cost.

The cap 3 and the inner cap 4 are mounted to the distal end of this body 2.

Here, the body 2 internally holds the core-like, long application member 5. As understood from the drawing, this application member 5 is constituted including an intermediate core 21 and an application brush 100, which is fitted onto the distal end of this intermediate core 21 and used for drawing.

Accordingly, the intermediate core 21 and the application brush 100 are usually made of a fiber member such that the liquid applying material 6, which will be described later, can be gradually impregnated by, for example, capillarity.

Reference numeral 7 denotes an absorbing body. As understandable from the drawing, this absorbing body 7 is formed into a columnar shape whose outer peripheral surface has no concavo-convex shape. The absorbing body 7 includes an elongate hole 80, which is disposed from an opening 200 disposed on the surface toward the far-side in the axial direction, at the center in the axial direction.

A rear end portion 22 of the application member 5 is fitted to this elongate hole 80 such that the application member 5 can contact the absorbing body 7, thus coupling both.

Conventionally, this absorbing body 7 has been manufactured with the resin molded product whose outer periphery has been configured as the uneven surface in the accordion shape. However, as described above, the cost taken for the mold of the resin molded product is high. This caused a problem of manufacturing the absorbing bodies 7 with a plurality of different kinds of forms resulted in the expensive cost of the applicators themselves.

Accordingly, the absorbing body 7 of the present invention is formed of the flexible member with impregnation force such as the foam material internally having the open cells. Easily cutting the size and the length of the absorbing body 7 can change the shape of the absorbing body 7 easily.

Reference numeral 9 denotes a nose piece. The nose piece 9 holds the distal end side of the core-like application member 5 and is fixedly secured to the tip end of the body 2. As described above, the application brush 100 is mounted to the distal end side of the application member 5 by fitted onto and coupled to the intermediate core 21. This application brush 100 performs the drawing or the application with the impregnated liquid applying material 6. Thus, the application member 5 may be configured by coupling separated components of the intermediate core 21 and the application brush 100 or by integrally forming the intermediate core 21 with the application brush 100.

Next, reference numeral 23 denotes a snorkel. This snorkel 23 is formed into a long, approximately tube shape such that the above-described intermediate core 21 can be inserted through a through-space 25 axially passing through the inside.

As understood from the drawing, the rear end of the intermediate core 21 is exposed by the snorkel 23, and the rear end portion 22 is fitted into and held by the elongate hole 80 of the absorbing body 7 as described above.

A space between the outer peripheral surface of the snorkel 23 and the inner peripheral surface of the body 2 is configured as the storage 12 for the liquid applying material 6.

Here, the distal end side of the snorkel 23 is configured as a tubular bulge body 26 having a hole larger than the shape of the through-space 25 into which the plug 11 is fitted.

Reference numeral 140 can also be referred to as a so-called second absorbing body. The second absorbing body 140 has a through-hole through which the intermediate core 21 passes. The end surface on one side is in contact with the end surface of the plug 11 while the end surface on the other side is locked to a lock protrusion 27 of the body 2 to be mounted into the body 2.

A through-space 25-1 on the rear end side of the snorkel 23 is not formed into a cylindrical shape in contact with the entire columnar outer peripheral surface of the intermediate core 21. For example, the through-space 25-1 is configured as the through-space 25 having a multangular shape such as a hexagon or an octagon, and the outer peripheral surface of the intermediate core 21 and the through-space 25 are in contact, for example, by six points or eight points. Meanwhile, clearances are generated at other outer peripheral surface positions such that the liquid applying material 6 can be impregnated from the clearances at the outer peripheral surfaces of the intermediate core 21. The air can be introduced from this clearance such that the liquid applying material 6 can be smoothly impregnated into the intermediate core 21, that is, the capillarity can be performed smoothly.

That is, a diameter of a through-space 25-2 positioned from an intermediate portion to the distal end side of the snorkel 23 is formed larger than the diameter of the intermediate core 21. Accordingly, the liquid applying material 6 can be flown into the through-space 25-2, which is positioned from the intermediate portion to the distal end side of the snorkel 23, and further the through-space 25-2 can be configured as the clearance into which the air can be flown, namely, a clearance portion 28.

The above-described absorbing body 7 is, for example, mounted to the rear end side of the tail plug 17. This tail plug 17 is inserted from the rear opening on the body 2 into the body 2, the intermediate core 21 is fitted into the elongate hole 80 of the absorbing body 7, the absorbing body 7 contacts and couples to the intermediate core 21, and the absorbing body 7 is arranged in the storage 12 where the liquid applying material 6 is accumulated. Therefore, the liquid applying material 6 is always impregnated into this absorbing body 7. Since this absorbing body 7 always contacts the intermediate core 21, the impregnated liquid applying material 6 can be supplied to the intermediate core 21 side by the capillarity. Accordingly, even if the amount of the liquid applying material 6 in the storage 12 decreases, the state where the applicator 1 is used parallel continues long, and the liquid applying material 6 in the storage 12 fails to reach the intermediate core 21 exposed to the storage member 12, the liquid applying material 6 can be supplied from the absorbing body 7 into which the liquid applying material 6 is preliminarily impregnated and therefore the liquid never runs out in the application brush 100. From this meaning, it can be said that the absorbing body 7 serves as a spare tank for the liquid applying material 6.

The following describes the assembly of the applicator according to the present invention. For example, the second absorbing body 140 is mounted to the distal end side of the snorkel 23, and the plug 11 is fitted into the snorkel 23 adjacent to this second absorbing body 140. The intermediate core 21 onto which the snorkel 23 is fitted is inserted from the rear of the body 2. Next, the tail plug 17 to which the absorbing body 7 is mounted is inserted from the rear of the body 2 to mount the intermediate core 21 at a predetermined position and the intermediate core 21 is brought into contact with the absorbing body 7 so as to be coupled, thus mounting the tail plug 17. Before the tail plug 17 is mounted, the storage 12 needs to be preliminarily filled with the liquid applying material 6.

Furthermore, the application brush 100 in which the nose piece 9 is mounted to the distal end side of the intermediate core 21 is coupled from the distal end side of the body 2. The inner cap 4 and the cap 3 are mounted to the distal end side of the body 2, completing the assembly of the applicator 1.

Figure 8:
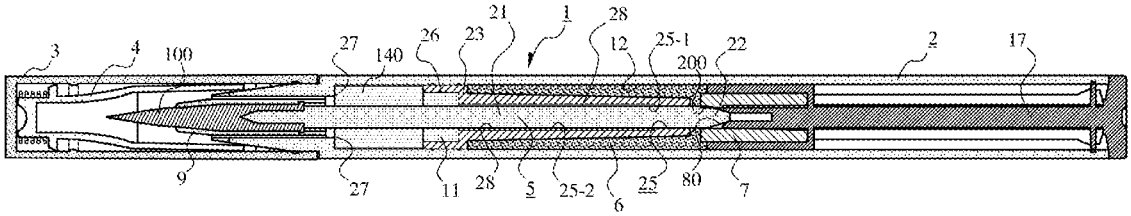
FIG. 8 is an explanatory view (4) describing a configuration of an applicator according to the present invention.
Figure 9:
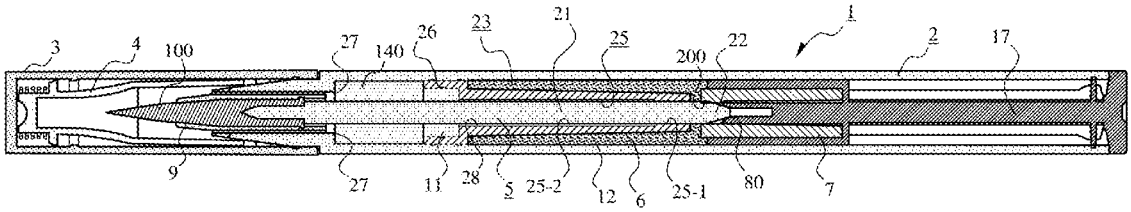
FIG. 9 is an explanatory view (5) describing a configuration of an applicator according to the present invention.

FIG. 8 and FIG. 9 illustrate other embodiments of the present invention and are examples of configurations of changing the length and the size of the absorbing body 7. Thus, the size and the length of the absorbing body 7 can be freely changed. Accordingly, even when the viscosity and the material of the liquid applying material 6 differ, the absorbing body 7 can serve as the spare tank for the liquid applying material 6 without causing a problem.

By forming the hole of the plug 11 into the multangular shape to provide the clearances, the clearances serve as introduction paths for the air, thereby ensuring smoothing the impregnation of the liquid applying material to the intermediate core 21.

The presence of the second absorbing body 140 allows adjusting the amount of impregnation of the liquid applying material 6 to the intermediate core 21. Therefore, a liquid leakage and running out of the liquid can be prevented.

Figure 10:
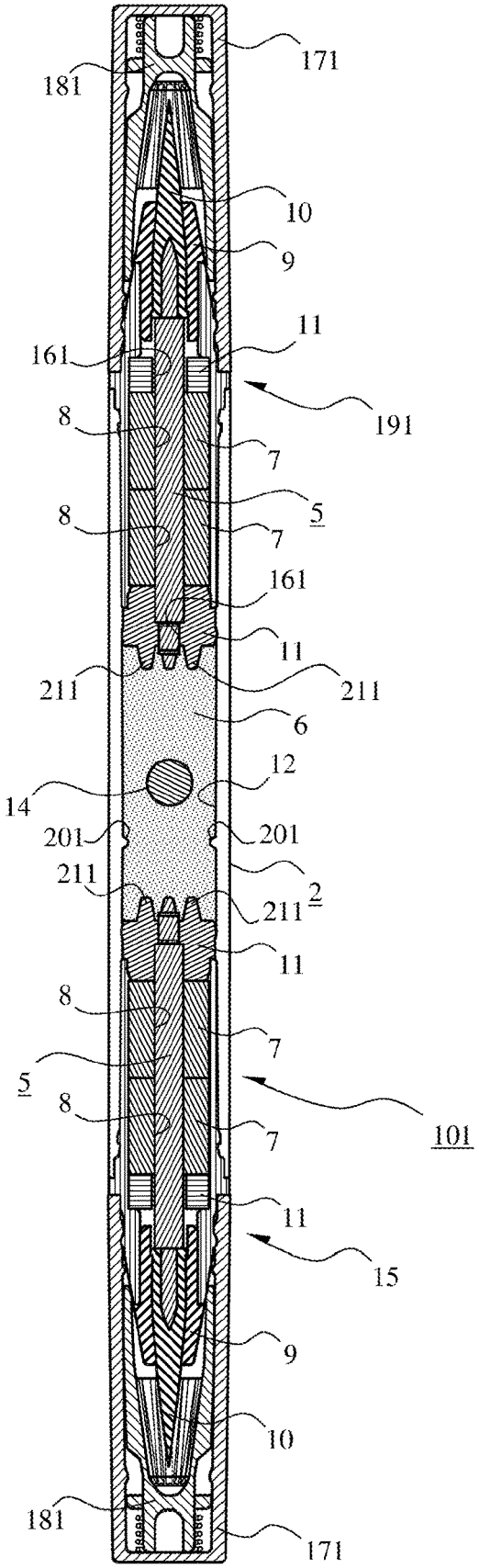
FIG. 10 is an explanatory view describing a configuration of an applicator for double use according to the present invention.

FIG. 10 is a configuration explanatory view illustrating a configuration of an applicator 101 for double use according to the present invention. The applicator 101 according to the present invention includes the approximately cylindrical-shaped body 2. This body 2 employs a configuration that includes a cap 171 and an inner cap 181 on both ends for ensuring the double use.

That is, the pair of core-like application members 5 are held from both sides and mounted in the body 2.

Here, the pair of application members 5 are usually made of the fiber member such that the liquid applying material 6, which will be described later, can be gradually impregnated by, for example, capillarity.

These application members 5 are mounted such that the two application members 5 are usable from both ends in the longitudinal direction of the body 2.

Next, reference numeral 7 denotes an absorbing body. As understandable from FIG. 10, these two absorbing bodies 7 are mounted in the longitudinal direction of the application members 5.

These absorbing bodies 7 are formed into the columnar shape whose outer peripheral surfaces have no concavo-convex shape. The absorbing bodies 7 include the through-holes 8, which axially pass through, at the center in the axial direction.

The application members 5 are inserted through and mounted to these through-holes 8. Conventionally, this absorbing body 7 has been manufactured with the resin molded product whose outer periphery has been configured as the uneven surface in the accordion shape. However, the cost taken for the mold of the resin molded product is high. Therefore, manufacturing the absorbing bodies 7 with a plurality of different kinds of forms resulted in the expensive cost of the applicators themselves.

Accordingly, the absorbing body 7 of the present invention is formed of the flexible member with impregnation force such as the foam material internally having the open cells. Easily cutting the size and the length of the absorbing body 7 can change the shape of the absorbing body 7.

Reference numeral 9 denotes a nose piece. The nose pieces 9 hold the distal end sides of the core-like application members 5 and are fixedly secured to the tip ends of the body 2. The drawing members 10 are fitted onto and mounted to the distal end sides of the application members 5. These drawing members 10 perform the drawing or the application with the impregnated liquid applying material 6.

Reference numeral 11 denotes a plug. The plugs 11 cause the rear end sides of the application members 5 to be inserted through the inside of the body 2 and hold the application members 5. The plugs 11 cause the rear end portions of the application members 5 to be exposed to the storage 12, which is formed adjacent to the plugs 11. The plugs 11 cause the rear end sides of the application members 5 to be inserted through insides of plug insertion holes 161 to hold the application members 5. A shape of these insertion holes 161 is formed into a different shape such as a square or a hexagonal shape. This configuration is made aiming to adjust a width of a clearance between the insertion hole 161 and the application member 5, which is inserted through the insertion hole 16, according to the viscosity and the material of the liquid applying material 6 and to adjust an amount of the liquid applying material 6 infiltrated to the absorbing body 7. Here, the storage 12 accumulates the liquid applying material 6.

The plugs 11 have projecting pieces 211, which project in the longitudinal direction of the body 2, on the storage 12 side. The projecting pieces 211 are formed such that the rear end portions of the application members 5 are positioned in the projecting pieces 211.

This formation ensures protection of the rear end portions of the application members 5 avoiding a direct collision of the ball 14 with the rear end portions of the application members 5.

The plugs 11 are also used at the intermediate positions of the application members 5. These plugs 11 disposed at the intermediate positions prevent the liquid leakage and excessive infiltration of the liquid applying material 6.

Reference numeral 14 denotes a ball. After the storage 12 accumulates the liquid applying material 6, putting this ball 14 into this storage 12 allows accelerating the impregnation of the liquid applying material 6 into the application members 5, thereby ensuring fully use of the liquid applying material 6 to the end. The applicator 1 for double use without the ball 14 exists.

Figure 12:
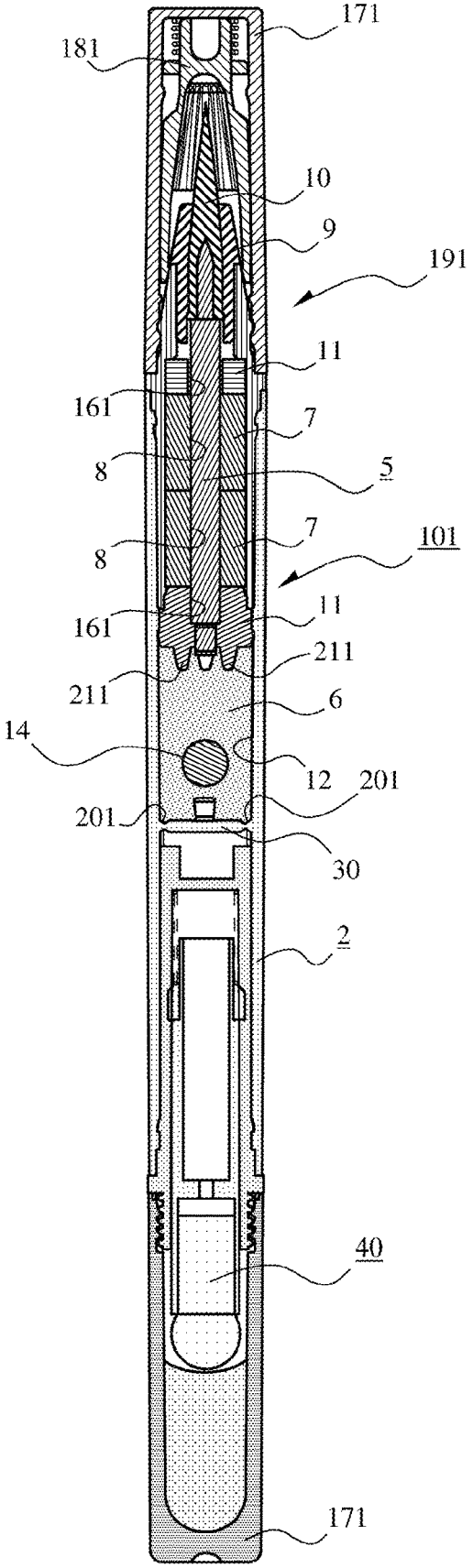
FIG. 12 is an explanatory view (2) describing a configuration of an applicator for double use according to another embodiment.
Figure 13:
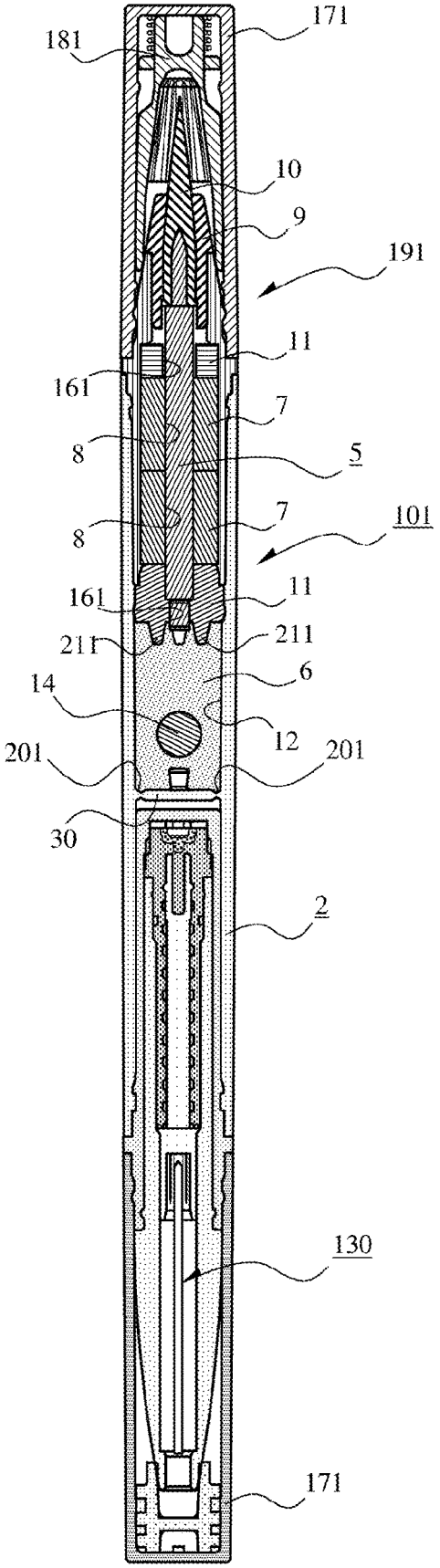
FIG. 13 is an explanatory view (3) describing a configuration of an applicator for double use according to another embodiment.

As illustrated in FIG. 12 and FIG. 13, a partition wall 30 that can be taken away is preliminarily disposed at the approximately intermediate position in the body 2 constituting the applicator 1 of the present invention.

Accordingly, this partition wall 30 has slits 201 at coupling portions of this partition wall 30 and the inner peripheral surfaces of the body 2. For example, pressing the partition wall 30 along the longitudinal direction of the body 2 allows the partition wall 30 to be detached from the body 2 easily.

The applicator 1 illustrated in FIG. 12 is a type that includes an applicator for drawing using the liquid applying material 6 on one side and a powder member 40 for face on the other side. Accordingly, the use of the applicator 1 for double use eliminates the need for taking away the partition wall 30 and supplying the liquid applying material 6 to the powder member 40. Therefore, the applicator 1 is used without taking away the partition wall 30.

The applicator 1 illustrated in FIG. 13 includes an applicator for drawing using the liquid applying material 6 on one side and a pencil member 130 for face on the other side. Accordingly, the use of the applicator 1 for double use eliminates the need for taking away the partition wall 30 and supplying the liquid applying material 6 to the pencil member 130. Therefore, the applicator 1 is used without taking away the partition wall 30.

Figure 11:
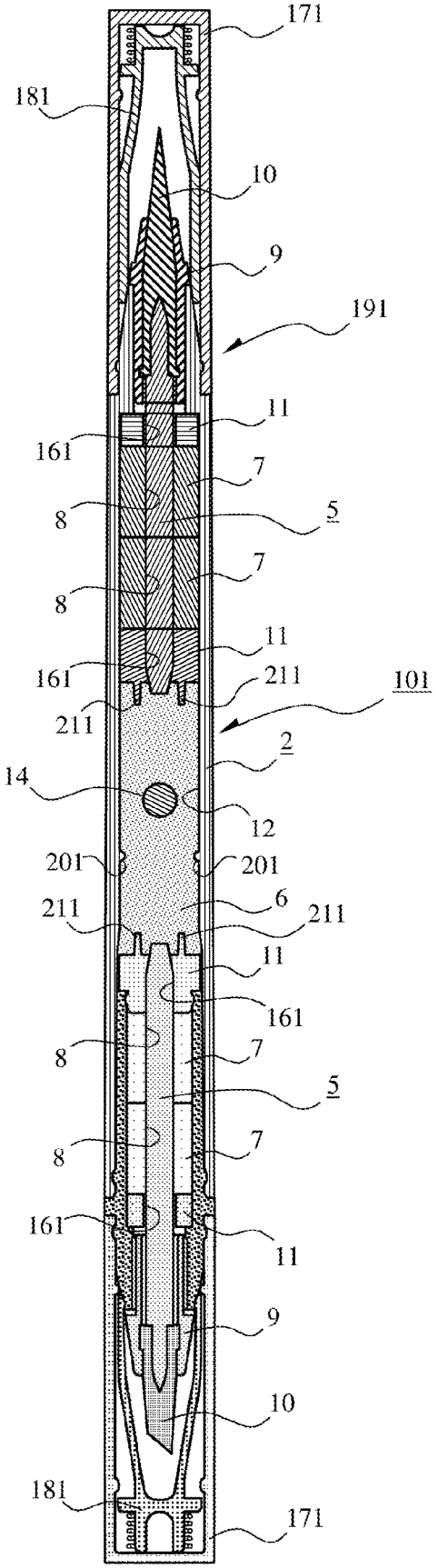
FIG. 11 is an explanatory view (1) describing a configuration of an applicator for double use according to another embodiment.

However, in the cases of FIG. 10 and FIG. 11, the applicators 1 are formed on both sides of the body 2, and both requires the use of the liquid applying material 6. Accordingly, it is necessary for such double use to take away the partition wall 30 for use. That is, this is because taking away the partition wall 30 allows the liquid applying material 6 to cover both applicators 101 by the one storage 12.

Moreover, variously preparing the drawing members 10 mounted to the distal ends of the application members 5 ensures providing the applicators 1 that can handle various uses.

Here, the following describes the assembly of the applicator 1 for double use.

First, the drawing member 10 is mounted to the distal end on the one side of the inside of the body 2 via the nose piece 9. The core-like application member 5 to which the absorbing body 7, which is cut to the desired length, and the plug 11 are mounted is mounted from the approximately intermediate position to the rear end side.

In this respect, the partition wall 30 is taking away and removed away. Afterwards, the liquid applying material 6 is filled from the rear end opening 15 of the body 2 in the storage 12 as the desired region space.

Afterwards, the other one application member 5 is inserted from the rear end side of the body 2. That is, the drawing member 10 is mounted to the distal end via the nose piece 9, and the core-shaped application member 5 to which the absorbing body 7 cut into the desired length and the plug 11 are mounted is inserted from the other side of the body 2 and mounted from the approximately intermediate position to the rear end side.

Next, the following describes the assembly of the applicator 101 for double use as illustrated in FIG. 12 and FIG. 13.

First, the drawing member 10 is mounted to the distal end on the one side of the inside of the body 2 via the nose piece 9. The core-like application member 5 to which the absorbing body 7, which is cut to the desired length, and the plug 11 are mounted is mounted from the approximately intermediate position to the rear end side.

In this respect, the partition wall 30 is not taken away but is left. That is, this is because the liquid applying material 6 is not used at both sides of the body 2.

Accordingly, the liquid applying material 6 is filled in the storage 12 as the desired region space from a distal end opening 191 side of the body 2, and then the application member 5 is mounted as described above.

Next, another kind of the applicator 101 that does not use the liquid applying material 6 is inserted from the rear end side of the body 2. That is, for example, the powder member 40 for face and the pencil member 130 for face are mounted to the other side.

Accordingly, such applicator is used without taking away the partition wall 30.

While FIG. 12 and FIG. 13 illustrate the examples where the powder member 40 for face and the pencil member 130 for face are mounted to the other side of the body 2 for use, this should not be construed in a limiting sense. As long as not using the liquid applying material 6, a member is mounted to this other side and the applicator can be configured as the applicator for double use. In such use, the body 2 is used with the partition wall 30 left as it is.

DESCRIPTION OF REFERENCE SIGNS

1 applicator
2 body
3 cap
4 inner cap
5 application member
6 liquid applying material
7 absorbing body
8 through-hole
9 nose piece
10 drawing member
11 plug
12 storage
13 stop plug
14 ball
15 rear end opening
16 insertion hole
17 tail plug
20 compression member
21 intermediate core
22 rear end portion of application member
23 snorkel
25 through-space
25-1 through-space on rear end side of snorkel
25-2 through-space positioned from intermediate position to distal end side of snorkel
26 tubular bulge body
27 lock protrusion
28 clearance portion
30 partition wall
40 powder member
80 elongate hole
100 application brush
101 applicator for double use
130 pencil member
140 second absorbing body
161 plug insertion hole
171 cap
181 inner cap
191 distal end opening of body
200 opening
201 slit
211 projecting piece

The invention claimed is:

1. An applicator comprising:
a body;
an application member inside the body;
a storage configured to accumulate a liquid applying material to be impregnated into the application member;
a liquid applying material absorbing body configured to adjust an amount of impregnation of the liquid applying material into the application member; and
a first plug configured to cause a rear end side of the application member to be inserted through an insertion hole in the first plug so as to hold the application member, the first plug being configured to expose the rear end side of the application member to a side of the storage,
wherein:
the storage has a storage region for the liquid applying material configured to be increased and decreased by changing a mounting position of a second plug; and
the liquid applying material absorbing body is mounted to the application member on a distal end side with respect to a mounting position of the first plug.

2. The applicator according to claim 1, wherein
the body is cylindrical.

3. The applicator according to claim 1, wherein
the application member includes a core.

4. The applicator according to claim 1, wherein
the liquid applying material absorbing body is cuttable.

5. The applicator according to claim 1, further comprising:
a third plug configured to cause the rear end side of the application member to be inserted through an insertion hole in the third plug so as to hold the application member, the third plug being configured to expose the rear end side of the application member to the side of the storage,
wherein:
the insertion hole of the first plug has a first shape;
the insertion hole of the third plug has a second shape; and
the first plug and the third plug are interchangeable.

6. The applicator according to claim 5, wherein:
one of the first shape and the second shape is square and the other of the first shape and the second shape is hexagonal.

7. An applicator comprising:
a body;
an application member inside the body;
a storage configured to accumulate a liquid applying material to be impregnated into the application member;
a liquid applying material absorbing body configured to adjust an amount of impregnation of the liquid applying material pin the application member; and
a compression member configured to compress the liquid applying material absorbing body,
wherein:
the compression member has a structure by which a degree of compression of the liquid applying material absorbing body is changeable and the amount of impregnation of the liquid applying material into the application member is adjustable; and
the storage has a storage region for the liquid applying material configured to be increased and decreased by changing a mounting position of a plug.

8. The applicator according to claim 7, wherein
the liquid applying material absorbing body is constituted of a foam material internally having an open cell structure.

9. The applicator according to claim 7, wherein
the storage internally includes a ball for stirring.

10. The applicator according to claim 7, wherein
the body is tube-shaped.

11. An applicator comprising:
a body;
an application member inside the body, the application member having a tip end configured to perform drawing from one end in a longitudinal direction of the body; and
a storage in the body, the storage being configured to accumulate a liquid applying material to be impregnated into the application member,
wherein:
the application member has a rear end side exposed to a side of the storage and a rear end portion of the application member is held, the application member being in contact with an absorbing body mounted to an inside of the storage, and the storage has a storage region for the liquid applying material configured to be increased and decreased by changing a mounting position of a plug.

12. The applicator according to claim 11, wherein the application member is made of a fiber member such that the liquid applying material is impregnatable by capillarity.

13. The applicator according to claim 11, wherein the application member includes a core and an application brush coupled to a distal end of the core.

14. The applicator according to claim 11, wherein the body is cylindrical.

15. The applicator according to claim 11, wherein the application member includes a core.

16. An applicator for double use, the applicator comprising:

a body;

a first application member inside the body, the first application member being configured to perform drawing from a first end side in a longitudinal direction of the body;

a storage at a rear end side of the first application member, the storage being configured to accumulate a liquid applying material to be impregnated into the first application member;

a liquid applying material absorbing body configured to adjust an amount of impregnation of the liquid applying material into the first application member; and a partition wall at a rear end side of the storage, wherein:

the partition wall has slits at coupling portions of the partition wall and inner peripheral surfaces of the body such that the partition wall is detachable and a second application member or a cosmetic member can be mounted at a second end side in the longitudinal direction of the body so as to be impregnated with the liquid applying material.

17. The applicator according to claim 16, wherein the body is cylindrical.

18. The applicator according to claim 16, wherein the first application member or the second application member includes a core.

* * * * *